US006876338B1

(12) United States Patent
Jones

(10) Patent No.: US 6,876,338 B1
(45) Date of Patent: Apr. 5, 2005

(54) FALL PROTECTION APPARATUS AND METHOD

(75) Inventor: Adam Jones, Windham, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/664,924

(22) Filed: Sep. 22, 2003

(51) Int. Cl.[7] ..... H01Q 1/12
(52) U.S. Cl. ..... 343/890; 182/3; 182/8
(58) Field of Search ..... 343/872, 878, 343/890, 891; 182/3, 8

(56) References Cited

U.S. PATENT DOCUMENTS 5,603,389 A * 2/1997 Zemon ..... 182/133
5,964,316 A * 10/1999 Roy ..... 182/3
6,241,045 B1 * 6/2001 Reeve et al. ..... 182/9

* cited by examiner

*Primary Examiner*—Hoang V. Nguyen
(74) *Attorney, Agent, or Firm*—Baker & Hostetler LLP

(57) ABSTRACT

An attachment apparatus for use with a generally vertical radio frequency antenna, the antenna having a housing defining an inside and an outside of the antenna, wherein the housing has an upper portion and a lower portion. The apparatus includes first and second anchor housings connected to the antenna along with a revolving cable having two sections. The attachment apparatus also includes at least one latching mechanism.

23 Claims, 3 Drawing Sheets

FALL PROTECTION APPARATUS AND METHOD

FIELD OF THE INVENTION

The present invention relates generally to a fall protection apparatus and method. More particularly, the present invention relates to an apparatus and method for supporting persons on a structure when climbing, for example, a tower, mast, antenna or other elevated structure for maintenance or any other purpose.

BACKGROUND OF THE INVENTION

Due to the enactment of various safety laws, persons working at elevated positions, for example, broadcast radio-frequency (RF) antennas or towers, are required to be protected against falls. The antennas commonly extend approximately 20–200 feet high and are typically mounted at the top of a tower, building or similar structure that can extend an additional 100–1500 feet high. Commonly, radiation emanates 360° from around the antenna's aperture and can radiate RF waves at powers ranging from approximately 10 kW to approximately 500 kW depending on the area to be covered.

Antenna installations like the one described above oftentimes employ fall prevention systems and/or attachment anchoring mechanisms that are connected to, or part of, the antenna. Typically, these fall prevention systems or attachment mechanisms typically utilize ropes or cables, referred to as rope grabs, to which a worker may anchor him or herself when installing, servicing, maintaining or sealing the antenna and or obstruction lights mounted on the antenna.

The rope or cables currently used in rope grabs are typically constructed from metal materials such as stainless steel, galvanized steel, aluminum and the like. Alternatively, other types of ropes currently used in fall prevention systems are constructed from synthetic materials such as nylon, polypropylene, Keviar® and the like.

The above-described ropes currently used in fall prevention systems have drawbacks however. For example, the synthetic ropes can be susceptible to the environment in which the antenna is located compromising the ropes' lifespan. Also, the synthetic materials from which the ropes are manufactured oftentimes do not resist ultraviolet (UV) rays or the RF radiation to which they are exposed, causing the ropes to break down or deteriorate over time. In addition, these synthetic ropes are also susceptible to the infiltration of water from the environment which also can lead to deterioration. Consequently, frequent maintenance and/or replacement of the ropes is sometimes required. Moreover, these ropes can be very expensive to manufacture or purchase. Thus, fall prevention systems currently employed in the art using synthetic materials may require frequent, costly maintenance. Additionally, with the absorption of water the material's dielectric constant is increased.

The ropes, or cables constructed from metal materials typically do not suffer from the above-described drawbacks associated with the use of synthetic ropes, however the metallic construction does have drawbacks. As previously described, an RF antenna typically emits a 360° radiation pattern. Metallic ropes will reflect the RF waves back to the antenna, causing a distortion of the radiation pattern. A metallic cable that is ungrounded can develop an electrical potential different from that of the antenna structure. This electrical potential can cause an are between the antenna structure and the cable. This will cause interference in the RF signal as well as destroy the cable.

Accordingly, there is a need in the art to provide a fall protection apparatus and method that is resistant to the environment in which it is deployed, reducing the amount of maintenance required for operation. Moreover, there is an additional need for a low maintenance fall protection system that is affordable. Further, there is a need for such an apparatus and method that minimizes distortion of the antenna's radiation pattern.

SUMMARY OF THE INVENTION

The foregoing needs are met, to a great extent, by the present invention, wherein in one aspect an attachment apparatus is provided for use with a generally vertical radio frequency antenna having a support frame defining an inside and an outside of the antenna. The support frame includes an upper portion and a lower portion. The attachment apparatus includes a first anchor housing connected to the upper portion of the support frame and a second anchor housing connected to the lower portion of the antenna housing. The apparatus also has a revolving cable which includes a first section constructed from a first material and a second section constructed from a second material. A portion of the cable is disposed within the support frame of the antenna and a portion of the cable is disposed outside of the support frame. The attachment apparatus also includes a latching mechanism that activates to prevent said cable from rotation.

In accordance with another embodiment of the present invention, a radio frequency antenna is provided having a means for supporting the antenna and defining an inside and an outside of the antenna. The support means has an upper portion and a lower portion. The attachment apparatus includes a first anchoring means connected to the upper portion of the support means and a second anchoring means connected to the lower portion of the support means. The apparatus also has a revolving cable having a first section constructed from a first material and a second section constructed from a second material. The cable is oriented so that at least a portion of the cable is disposed within the supporting means of the antenna and at least a portion of said cable is disposed outside of the supporting means. The apparatus also has a means for latching the cable and a latching means that prevents said cable means from rotating.

In accordance with yet another embodiment of the present invention, a method for attaching to a vertical radio frequency wave emitting structure having an antenna, wherein the antenna has a support frame defining an inside and an outside of the antenna and an upper portion and a lower portion, and including a revolving cable that extends between the upper portion and the lower portion, wherein the cable comprises two sections made from two materials, is provided comprising the steps of: rotating the cable to a first operational position, locking the cable in the first position to prevent the cable from further rotation, and attaching an attachment mechanism to the revolving cable.

In accordance with still another embodiment of the present invention, a radio frequency antenna is provided. The radio frequency antenna includes a support frame that supports the antenna and defines an inside and an outside of the antenna. The support frame includes an upper portion and a lower portion along with a first anchor connected to the upper portion and lower anchor connected to the lower portion. The radio frequency antenna also includes a revolving cable having a first section constructed from a first material and a second section constructed from a second material. At least a portion of the cable is disposed within the support frame of the antenna while at least a portion is dispose outside the support frame of the antenna. The radio frequency antenna additionally includes at least one latching mechanism that prevents the cable from rotating.

In accordance with yet another embodiment of the present invention, an attachment apparatus is provided for use with a generally vertical radio frequency antenna having a support frame defining an inside and an outside of the antenna. The support frame includes an upper portion and a lower portion. The attachment apparatus includes a first anchor housing connected to the upper portion of the support frame and a second anchor housing connected to the lower portion of the antenna housing. The apparatus also has a revolving cable which includes a first section constructed from a first material and a second section constructed from a second material. A portion of the cable is shielded from RF energy during antenna operation and a portion of the cable is exposed to RF energy during antenna operation. The attachment apparatus also includes a latching mechanism that activates to prevent said cable from rotation.

In accordance with another embodiment of the present invention, a radio frequency antenna is provided. The radio frequency antenna includes a support frame that supports the antenna and defines an inside and an outside of the antenna. The support frame includes an upper portion and a lower portion along with a first anchor connected to the upper portion and lower anchor connected to the lower portion. The radio frequency antenna also includes a revolving cable having a first section constructed from a first material and a second section constructed from a second material. At least a portion of the cable is shielded from RF energy during antenna operation while at least a portion is exposed to RF energy during antenna operation. The radio frequency antenna additionally includes at least one latching mechanism that prevents the cable from rotating.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
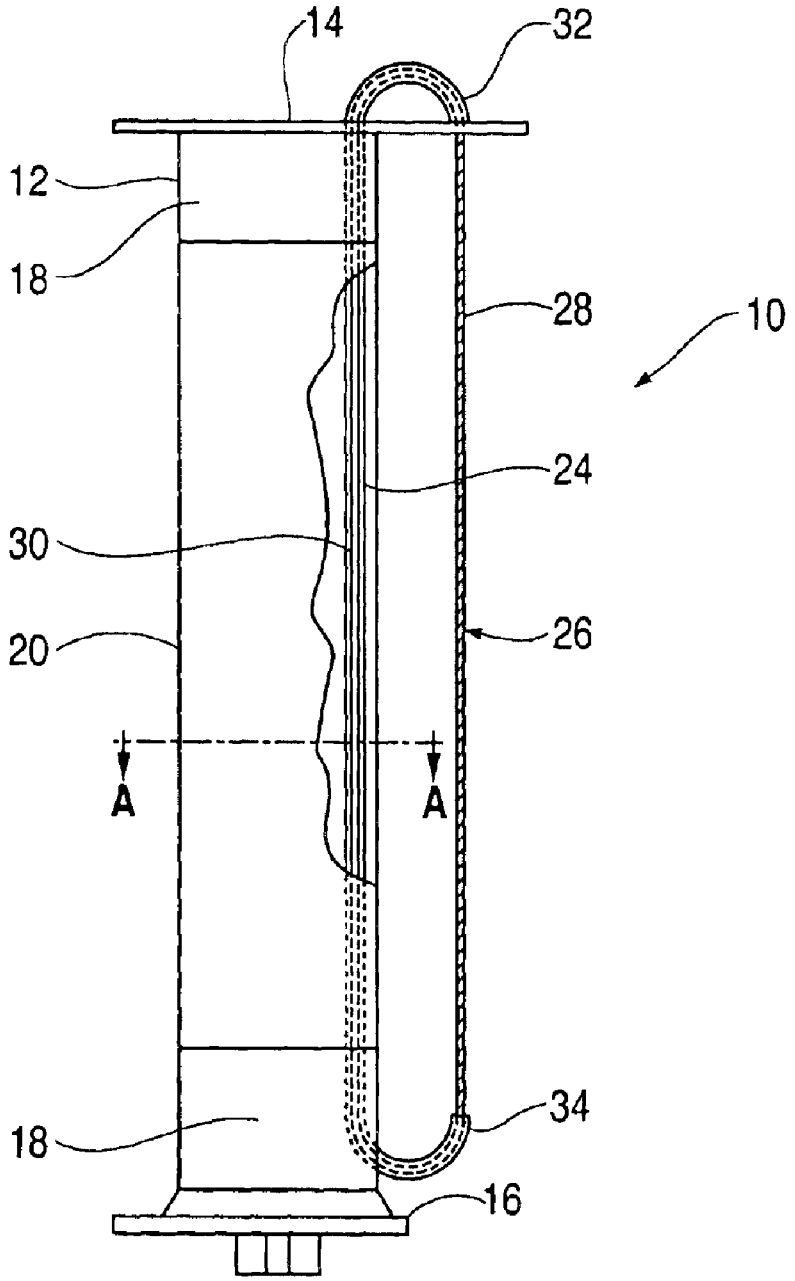
FIG. 1 is a side perspective view of a fall prevention apparatus installed on a vertical top mount antenna, in accordance with an embodiment of the present invention.

Various preferred embodiments of the present invention provide for a safety apparatus and method for securing a person to an elevated structure or work area. In some arrangements, the apparatus and method are utilized as a fall prevention system for attaching persons to a structure or anchor when climbing a vertical top mounted antenna to perform maintenance or other tasks. It should be understood, however, that the present invention is not limited in its application top mounted antennas or the broadcast industry, but, for example, can be used with other processes and industries that require a system for preventing persons from falling when climbing for example, a pylon, tower, vertical structure or the like. Embodiments of the present invention may also be suitable to hoist or support other objects besides or in addition to persons, such as, for example, equipment or other objects. The invention will now be further described with reference to the drawing figures, in which like reference numerals refer to like parts throughout.

Figure 2:
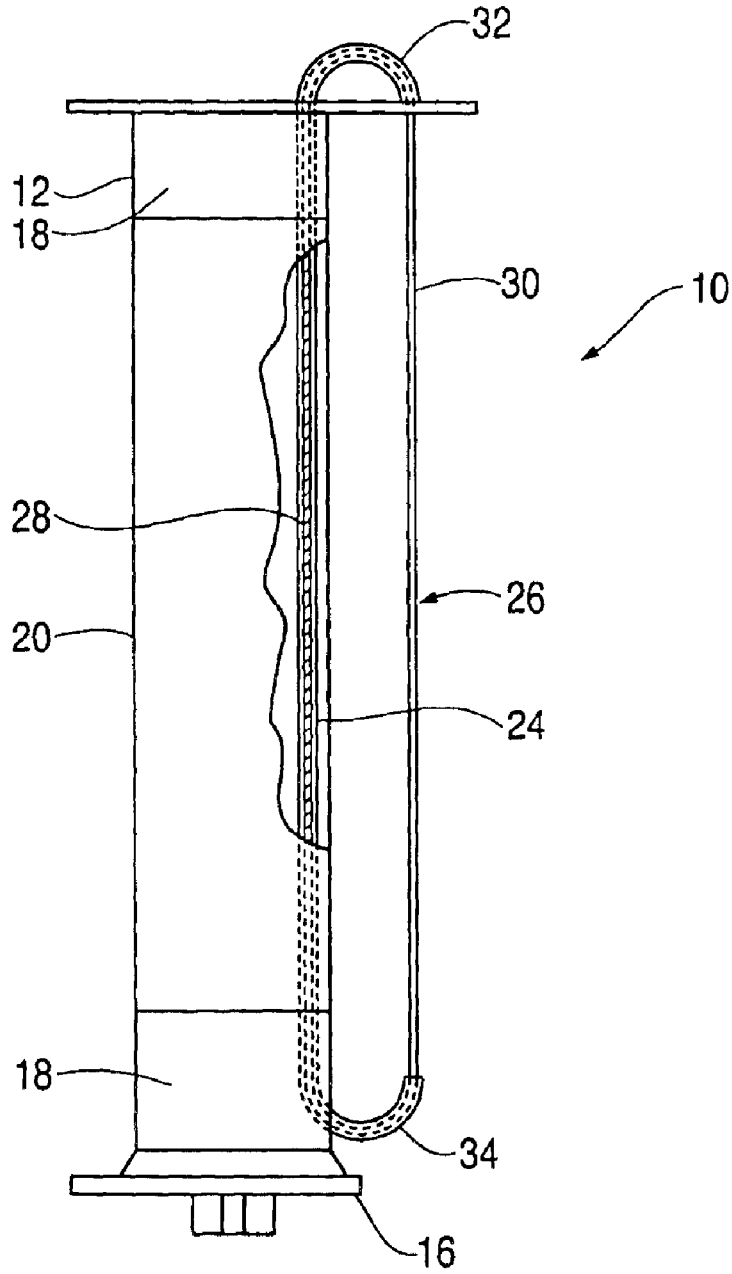
FIG. 2 is a side, perspective view of the fall prevention apparatus depicted in FIG. 1 in an operating position.

Referring now to the figures, FIGS. 1–3 and 5 illustrate a fall prevention system, generally designated 10, in accordance with an embodiment of the present invention. Whereas FIG. 1 depicts the apparatus 10 in the non-operational position, FIG. 2 depicts the apparatus 10 in the operational position.

As illustrated in the FIGS. 1–3 and 5, the system 10 is installed or attached to a generally vertical top mount antenna 12, for example, of a high power RF broadcasting antenna. The antenna 12 generally includes a top 14, a base 16, a support frame 18, a shroud made from low dielectric constant material 20 and a plurality of radiators 22. The antenna 12 also includes an inner conduit 24 positioned within the support frame 18 that extends at least partially but preferably the entire distance between the base 16 and the top 14 of the antenna 12.

Figure 5:
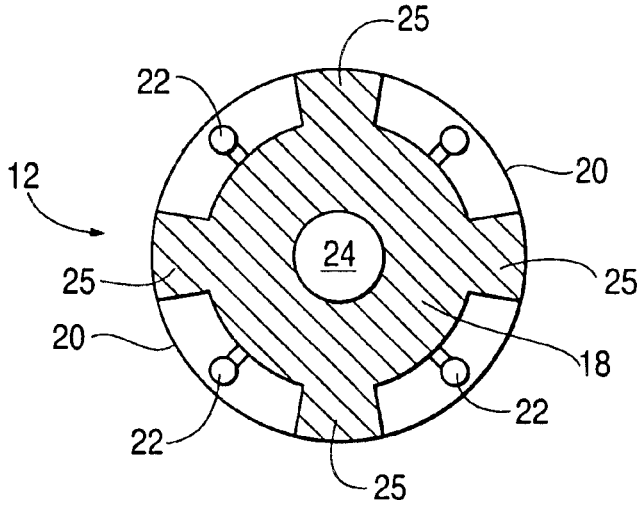
FIG. 5 is a cross-sectional view of the apparatus depicted in FIG. 1 taken along line A—A.

FIG. 5 is a cross section view of the fall prevention system 10 in combination with an antenna 12, showing as an example a central conduit 24. The present invention embodies alternative designs which may include antennas with more or less radiators 18 and/or antennas which have multiple inner conduits 24. In addition, the inner conduit(s) 24 need not be central, but may be oriented at varying positions within the antenna 12 itself. For example, conduits 24 may be located in some or all radial fins 25 of the support frame 16.

The fall prevention apparatus 10 generally includes a safety rope or cable 26 mounted generally vertical along the top mount antenna 12. As illustrated in FIGS. 1–4, the rope or cable 26 is preferably a single, continuous revolving or rotatable loop having two sections. The safety rope or cable 26 extends generally parallel to the outside of the antenna 12. It then extends from the base 16 to the top 14 through the conduit 24 through the support frame 18 of the antenna 12.

The first cable section, generally designated 28, is preferably constructed from a metallic or metal alloy material such as stainless steel and is used for securing a person to the antenna 12 when the apparatus 10 is in the operational position. The second cable section, generally designated 30, is a "messenger" rope or section, preferably manufactured from synthetic materials of low dielectric constant such as Kevlar® or polypropylene. The messenger section 30 is utilized to translate or promote the rope or cable 26 from the non-operational position as depicted in FIG. 1, to the operational position as depicted in FIG. 2.

Figure 3:
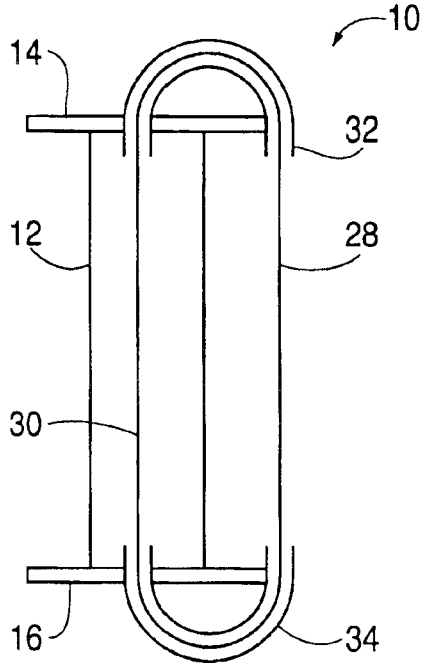
FIG. 3 is a detailed side schematic view of the fill prevention apparatus installed depicted in FIGS. 1 and 2.

As depicted in FIGS. 1–3, in one embodiment of the present invention, the safety rope or cable assembly 26 is anchored to the top 14 of the antenna 12 via an anchor housing 32 and to the base 16 via another anchor housing 34. The anchor housings 32, 34 are preferably curved or shaped conduits having inner channel surfaces that allow the cable assembly 26 to slide over the channels to be rotated from the non-operational position to the operational position and vice versa. In the embodiments depicted, the anchor conduits 32, 34 are proximate to the inner conduit 24 that extends between the top 14 and the base 16, to provide a single, continuous path within which the rope or cable assembly 26 may travel. The anchor conduits 32, 34, however may be positioned anywhere in the antenna support frame 18 so long as the anchor conduits 32, 34 are grounded to the antenna 12.

The anchor housings 32 and/or 34 include a latching mechanism or brake such as is known in the art, for example a cam arrestor, that functions to stop rapid cable assembly 26 movement and/or to lock the cable assembly 26 in position when the apparatus 10 is in operation. The anchor housings 32, 34 additionally include tension equalization systems known in the art which assist to reduce cable weight differentiation which can occur when the apparatus 10 is in operation. Anchor housing may also include lock out/tag out device to prevent accidentally applying power to the antenna 12 while apparatus 10

FIG. 5 illustrates a detailed cross-sectional view taken along line A—A in FIG. 1. The cross-sectional view is an exemplary depiction of an antenna 12 that may be used in combination with the fall prevention apparatus 10 of the present invention. As depicted, the antenna 12 is an RF antenna having four radiators 22, a support frame 18 and a radio-transparent skin 20 (known within the industry as a radome.

The radio-transparent skin 20 can be any protective layering known in the art whose properties exhibit a low dielectric constant, thus allowing for RF transmission while functioning as a barrier between the inner components of the antenna 12 and the environment in which the antenna is deployed. Preferably, the aforementioned barrier or skin is constructed from a polycarbonate and/or fiberglass material. The antenna 12 additionally includes an inner housing 24. As one skilled in the art would appreciate, an RF antenna like the one depicted in FIG. 5 most likely would employ significantly more radiators 22 than the four shown. However, some RF antenna designs may employ less. Moreover, though a single, centralized inner conduit 24 through which the cable assembly 26 travels is depicted, alternative embodiments may be employed. For example, the inner conduit 24 need not be centralized and can be positioned along the circumference or outer boundaries of the support frame 18 such as being in one or more of the radial fins 25. The conduit 24 may also be attached and grounded to the support structure 18 of the antenna 12. Furthermore, the cable assembly 26 may be positioned at a location between the radio-transparent skin 20 and the frame assembly 18, for example in the space adjacent or next to the radiators 22, or the cable 26 need not travel through the inside of the support frame 18 at all.

Referring now to FIG. 1, the fall prevention apparatus 10 is depicted in the non-operational position. By non-operational position, it is understood that the antenna 12 is functioning and the radiators are emitting RF energy. In this position, the cable assembly 26 is rotated and locked in a first position as indicated in FIG. 1. In the aforementioned first position, the first section 30 (or metallic section) of the cable assembly 26 is disposed within the inner housing conduit 24, shielded from the RF energy being emitted by the radiators 22. Moreover, the second section 28 of the cable assembly 26 is located on the outside of the antenna 12. In the non-operational position, the anchor housings 32, 34 preferably assist to shield the first section 28 also.

Accordingly, in the aforementioned non-operational position, the first section 30 is shielded from the RF energy, reducing the likelihood of RF signal interference and reducing the likelihood that the cable will be destroyed by arcing.

As shown in FIG. 2, the fall prevention apparatus 10 is in operational position. By operational position it is understood that the radiators 18 of the antenna 12 are not actively emitting RF energy and the cable assembly 26 is rotated and locked in a second position. In the aforementioned second position, the first section 28 (or metallic section) extends along the outside of antenna 12. In this position, the cable is securely locked in a stationary position via the latching mechanism and the tension equalization system. In the operational position, the cable assembly 26 provides an anchor and/or attachment point to a person wearing a harness or any other suitable climbing system may attach a device typically known of as a rope grab.

Figure 4:
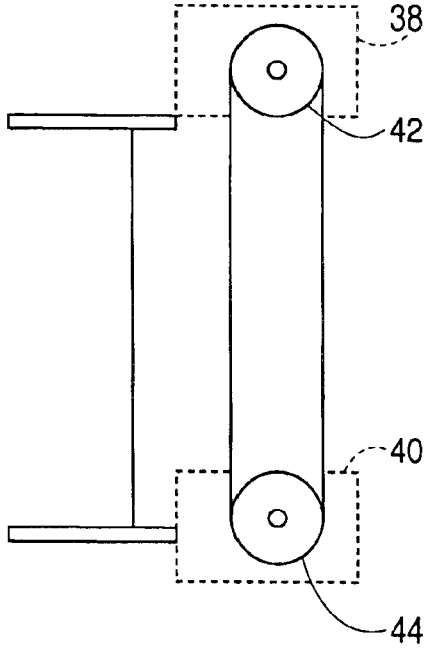
FIG. 4 is a detailed side schematic view of a fall prevention apparatus installed on a vertical top mount antenna, in accordance with another embodiment of the present invention.

Referring now to FIG. 4, an alternative embodiment of the present invention is illustrated. Instead of the fixed, channel type anchor housings 32, 34 utilized in the embodiments depicted in FIGS. 1–3, the embodiment depicted in FIG. 4 employs anchor housings 38, 40 that function via a wheeled pulley system. As illustrated in FIG. 4, each of the anchor housings 38, 40 employs a pulley wheel 42, 44 that allows the cable to be rotated from the non-operational position to the operational position and vice versa. Like the embodiment depicted in FIGS. 1–3, these housings 38, 40 include latching mechanisms or brakes known in the art such as cam arrestors, that function stop rapid cable assembly 26 movement and/or to lock the cable assembly 26 in position when the apparatus 10 is in operation. And like the previous described embodiment, the anchor housings 38, 40 additionally include tension, equalization systems known in the art which assist to reduce cable weight differentiation which can occur when the apparatus 10 is in operation.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An attachment apparatus for use with a generally vertical radio frequency antenna having a support frame defining an inside and an outside of the antenna, the housing having an upper portion and a lower portion, comprising:

a first anchor housing connected to the upper portion of the support frame;

a second anchor housing connected to the lower portion of the support frame;

a revolving cable having a first section constructed from a first material and a second section constructed from a second material, wherein at least a portion of said cable is disposed within the support frame of the antenna and wherein at least a portion of said cable is disposed outside of said support frame; and at least one latching mechanism that activates to prevent said cable from rotation.

2. The apparatus according to claim 1, wherein said first and second anchor housings each comprise shaped channels.

3. The apparatus according to claim 1, wherein said first section of said revolving cable is positioned within the antenna housing during antenna operation and said second section of said revolving cable is positioned on the outside of the antenna housing during antenna operation.

4. The apparatus according to claim 1, wherein said first section of said revolving cable is positioned on the outside of the antenna housing during antenna maintenance and said second section of said revolving cable is positioned within the antenna housing during antenna maintenance.

5. The apparatus according to claim 1, wherein said first material is metal or metal alloy and wherein said second material is a synthetic, low dielectric constant material.

6. The apparatus according to claim 5, wherein said first material is aluminum or stainless steel and said second material is nylon, polypropylene or Kevlar®.

7. The apparatus according to claim 1, wherein said revolving cable is a single, unitary loop.

8. The apparatus according to claim 1, further comprising a second latching mechanism that prevents said revolving cable from rotation, wherein said at least one latching mechanism is disposed within said first anchor housing and said second latching mechanism is disposed with said second anchor housing.

9. The apparatus according to claim 8, wherein said latching mechanisms are each cam actuated arrestors.

10. The apparatus according to claim 1, wherein said first anchor housing comprises a first pulley for rotating said revolving cable and said second anchor housing comprises a second pulley for rotating said revolving cable.

11. The apparatus according to claim 1, further comprises a tension, equalization system connected to said attachment apparatus.

12. A radio frequency antenna, comprising:

means for supporting the antenna and defining an inside and an outside of the antenna the supporting means having an upper portion and a lower portion, comprising:

a first anchoring means connected to the upper portion of said supporting means;

a second anchoring means connected to the lower portion of said supporting means;

a revolving cable having a first section constructed from a first material and a second section constructed from a second material, wherein at least a portion of said cable is disposed within said supporting means of the antenna and wherein at least a portion of said cable means is disposed outside of said supporting means;

means for preventing rotation of said revolving cable; and at least one latching means for preventing said cable from rotating.

13. The apparatus according to claim 12, wherein said first and second anchor means each comprise shaped channels.

14. The apparatus according to claim 13, wherein said first section of said revolving cable means is positioned within the support means during antenna operation and said second section of said revolving cable means is positioned on the outside of the support means during antenna operation.

15. The apparatus according to claim 13, wherein said first section of said revolving cable means is positioned on the outside of the support means during antenna maintenance and said second section of said revolving cable means is positioned within the support means during antenna maintenance.

16. The apparatus according to claim 13, wherein the first material is metal or metal alloy and wherein the second material is a synthetic, low dielectric constant material.

17. The apparatus according to claim 16, wherein the first material is aluminum or stainless steel and the second material is nylon, polypropylene or Kevlar®.

18. The apparatus according to claim 13, wherein said revolving cable is a single, unitary loop.

19. A method for attaching to a vertical radio frequency wave emitting structure having an antenna, wherein the antenna has a support frame defining an inside and an outside of the antenna and an upper portion and a lower portion, the support frame also including a revolving cable that extends between the upper portion and the lower portion, wherein the cable comprises two sections made from two materials, comprising:

rotating the revolving cable to a first, operational position;

locking the revolving cable in the first position, preventing the revolving cable from further rotation; and attaching an attachment mechanism to the revolving cable.

20. The method according to claim 19, further comprising the steps of:

detaching the attachment mechanism from the revolving cable; and rotating the revolving cable to a second, non-operational position.

21. A radio frequency antenna, comprising:

a support frame that supports the antenna and defines an inside and an outside of the antenna wherein the support frame has an upper portion and a lower portion;

a first anchor connected to the upper portion of said support frame;

a second anchor connected to the lower portion of said support frame;

a revolving cable having a first section constructed from a first material and a second section constructed from a second material, wherein at least a portion of said revolving cable is disposed within said support frame of the antenna and wherein at least a portion of said cable is disposed outside of said support frame of the antenna; and at least one latching mechanism that prevents said revolving cable from rotating.

22. An attachment apparatus for use with a generally vertical radio frequency antenna having a support frame defining an inside and an outside of the antenna, the housing having an upper portion and a lower portion, comprising:

a first anchor housing connected to the upper portion of the support frame;

a second anchor housing connected to the lower portion of the support frame;

a revolving cable having a first section constructed from a first material and a second section constructed from a second material, wherein said first section of said revolving cable is shielded from RF energy during antenna operation and wherein said second section of said revolving cable is exposed to RF energy during antenna operation; and at least one latching mechanism that activates to prevent said cable from rotation.

23. A radio frequency antenna, comprising:

a support frame that supports the antenna and defines an inside and an outside of the antenna wherein the support frame has an upper portion and a lower portion;

a first anchor connected to the upper portion of said support frame;

a second anchor connected to the lower portion of said support frame;

a revolving cable having a first section constructed from a first material and a second section constructed from a second material, wherein at least a portion of said revolving cable is exposed to RF radiation during antenna operation and wherein at least a portion of said revolving antenna is shield from RF energy during antenna operation; and at least one latching mechanism that prevents said revolving cable from rotating.

* * * * *